US011264724B2

(12) United States Patent
Miller

(10) Patent No.: US 11,264,724 B2
(45) Date of Patent: Mar. 1, 2022

(54) OMNIDIRECTIONAL ANTENNA ASSEMBLY

(71) Applicant: TE Connectivity Services GmbH, Schaffhausen (CH)

(72) Inventor: Alan W. Miller, Milan, MI (US)

(73) Assignee: TE Connectivity Services GmbH

( * ) Notice: Subject to any disclaimer, the term of this patent is extended or adjusted under 35 U.S.C. 154(b) by 38 days.

(21) Appl. No.: 16/933,271

(22) Filed: Jul. 20, 2020

(65) Prior Publication Data

US 2022/0021122 A1 Jan. 20, 2022

(51) Int. Cl.
*H01Q 13/16* (2006.01)
*H01Q 13/18* (2006.01)
*H01Q 1/48* (2006.01)

(52) U.S. Cl.
CPC ..... *H01Q 13/16* (2013.01); *H01Q 1/48* (2013.01); *H01Q 13/18* (2013.01)

(58) Field of Classification Search
CPC ..... H01Q 13/16; H01Q 1/48; H01Q 13/18
See application file for complete search history.

(56) References Cited

U.S. PATENT DOCUMENTS 6,307,520 B1 * 10/2001 Liu ..... H01Q 23/00 343/702
6,639,560 B1 * 10/2003 Kadambi ..... H01Q 1/243 343/700 MS
7,262,739 B2 * 8/2007 Chen ..... H01Q 1/362 343/700 MS
10,879,617 B1 * 12/2020 Rivera ..... H01Q 1/364
2001/0052877 A1 * 12/2001 Honda ..... H01Q 9/42 343/702
2004/0027292 A1 * 2/2004 Gabriel ..... H01Q 9/0414 343/700 MS
2009/0153416 A1 * 6/2009 Arbin ..... H01Q 1/243 343/702
2011/0090128 A1 * 4/2011 Sulima ..... H01Q 13/18 343/767
2015/0162663 A1 * 6/2015 Boryssenko ..... H01Q 21/065 343/848
2017/0201028 A1 * 7/2017 Eberhardt ..... H01Q 1/38
2017/0222326 A1 * 8/2017 Wight ..... H01Q 9/0421
2019/0229428 A1 * 7/2019 Beskov ..... H05K 1/0284
2020/0295447 A1 * 9/2020 Zhao ..... G06F 1/1698
2020/0303824 A1 * 9/2020 Barrera ..... H01Q 13/18
2021/0184360 A1 * 6/2021 Leung ..... H01Q 9/0428

* cited by examiner

*Primary Examiner* — Graham P Smith
*Assistant Examiner* — Jae K Kim

(57) ABSTRACT

An antenna includes a feed element, a ground element, and a slot therebetween. The feed element includes a feed end wall and first and second feed side walls extending from the feed end wall at first and second corners. The ground element includes a ground end wall and first and second ground side walls at first and second corners. The slot includes a first slot portion between the first feed and ground side walls, a second slot portion between the second feed and ground side walls, and a third slot portion between the feed and ground end walls. The third slot portion is continuous between the first slot portion and the second slot portion.

20 Claims, 5 Drawing Sheets

OMNIDIRECTIONAL ANTENNA ASSEMBLY

BACKGROUND OF THE INVENTION

The subject matter herein relates generally to antenna assemblies.

Antennas are used to transmit and/or receive electromagnetic waves, such as for communication. Some known antennas, known as slot antennas, include a metal plate having a hole or slot formed therein. Such antennas are basic antenna elements and may be manufactured in a cost effective manner. However, such antennas are not without disadvantages. For instance, slot antennas are directional and have radiation patterns that have large nulls or areas of poor performance.

A need remains for a cost effective and reliable antenna providing omnidirectional antenna coverage.

BRIEF DESCRIPTION OF THE INVENTION

In one embodiment, an antenna is provided including a feed element, a ground element, and a slot between the feed element and the ground element. The feed element includes a feed end wall, a first feed side wall, and a second feed side wall. The first feed side wall extends from a first side of the feed end wall at a first corner and the second feed side wall extends from a second side of the feed end wall at a second corner. The ground element includes a ground end wall, a first ground side wall, and a second ground side wall. The first ground side wall extends from a first side of the ground end wall at a first corner and the second ground side wall extends from a second side of the ground end wall at a second corner. The slot includes a first slot portion between the first feed side wall and the first ground side wall, a second slot portion between the second feed side wall and the second ground side wall, and a third slot portion between the feed end wall and the ground end wall. The third slot portion is continuous between the first slot portion and the second slot portion.

In an embodiment, an antenna assembly is provided including an antenna including a feed element, a ground element and a slot between the feed element and the ground element. The feed element includes a feed end wall, a first feed side wall, and a second feed side wall. The first feed side wall extends from a first side of the feed end wall at a first corner and the second feed side wall extends from a second side of the feed end wall at a second corner. The ground element includes a ground end wall, a first ground side wall, and a second ground side wall. The first ground side wall extends from a first side of the ground end wall at a first corner and the second ground side wall extends from a second side of the ground end wall at a second corner. The slot includes a first slot portion between the first feed side wall and the first ground side wall, a second slot portion between the second feed side wall and the second ground side wall, and a third slot portion between the feed end wall and the ground end wall. The third slot portion is continuous between the first slot portion and the second slot portion. The antenna assembly includes an antenna cable including a cable feed electrically connected to the feed element and a cable ground electrically connected to the ground element.

In an embodiment, an antenna assembly is provided including a substrate having an upper surface and an antenna mounted to the upper surface of the antenna. The antenna includes a feed element, a ground element and a slot between the feed element and the ground element. The feed element includes a feed end wall, a first feed side wall, and a second feed side wall. The first feed side wall extends from a first side of the feed end wall at a first corner and the second feed side wall extends from a second side of the feed end wall at a second corner. The ground element includes a ground end wall, a first ground side wall, and a second ground side wall. The first ground side wall extends from a first side of the ground end wall at a first corner and the second ground side wall extends from a second side of the ground end wall at a second corner. The slot includes a first slot portion between the first feed side wall and the first ground side wall, a second slot portion between the second feed side wall and the second ground side wall, and a third slot portion between the feed end wall and the ground end wall. The third slot portion is continuous between the first slot portion and the second slot portion. The antenna assembly includes an antenna cable including a cable feed electrically connected to the feed element and a cable ground electrically connected to the ground element.

DETAILED DESCRIPTION OF THE INVENTION

Figure 1:
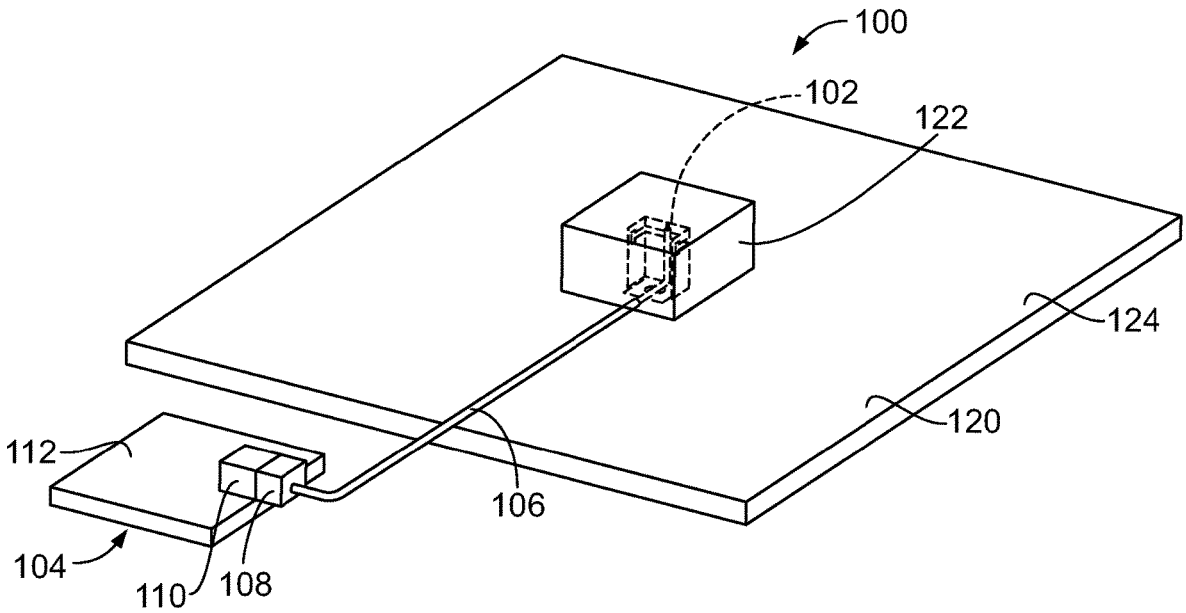
FIG. 1 illustrates an antenna assembly in accordance with an exemplary embodiment.

FIG. 1 illustrates an antenna assembly 100 in accordance with an exemplary embodiment. The antenna assembly 100 includes an antenna 102 used to transmit and/or receive electromagnetic waves. The antenna 102 is electrically connected to a component 104. In the illustrated embodiment, the antenna 102 is electrically connected to the component 104 through a coaxial cable 106 and a cable connector 108 provided at an end of the coaxial cable 106. The cable connector 108 is configured to be coupled to an electrical connector 110 of the component 104. The electrical connector 110 is mounted to a circuit board 112 of the component 104. In alternative embodiments, the antenna 102 may be directly couple to the circuit board 112 without the coaxial cable 106 and/or the cable connector 108 and/or the electrical connector 110.

In an exemplary embodiment, the antenna 102 is mounted to a substrate 120. An antenna housing 122 is mounted to the substrate 120 and supports or protects the antenna 102. In various embodiments, the substrate 120 may be a circuit board. In an exemplary embodiment, the substrate 120 includes a ground plane 124 for the antenna 102. The substrate 120 may be metallic in various embodiments, such as being a metal plate. The substrate 120 may be dielectric in various embodiments, such as being a plastic plate, wall, housing, or other component. In alternatively embodiments, the antenna 102 may be mounted to another structure or may be free-standing rather than being mounted to the substrate 120.

Figure 2:
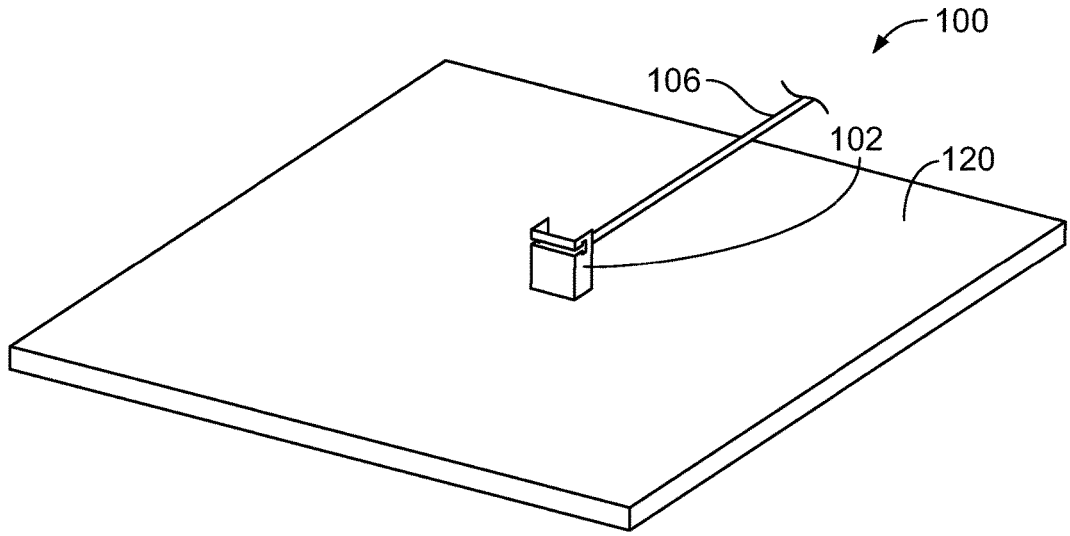
FIG. 2 illustrates the antenna assembly showing an antenna in accordance with an exemplary embodiment mounted to a substrate.

FIG. 2 illustrates the antenna assembly 100 showing the antenna 102 mounted to the substrate 120 without the antenna housing 122 (shown in FIG. 1). The coaxial cable 106 is electrically connected to the antenna 102. In an exemplary embodiment, the antenna 102 is a slot antenna having a slot between a feed element and a ground element. A cable feed of the coaxial cable 106 is electrically connected to the feed element and a cable ground of the coaxial cable 106 is electrically connected to the ground element. In an exemplary embodiment, the antenna 102 is an omnidirectional antenna. The antenna 102 includes various plates or walls that are angled relative to each other and oriented to face in different directions, such as perpendicular directions. In an exemplary embodiment, the antenna 102 is vertically polarized. The feed element and the ground element are oriented vertically, such as perpendicular to the substrate 120. In an exemplary embodiment, the antenna 102 is stamped and formed from a metal sheet to include the slot between the feed element and the ground element. The sheet metal is formed by bending the sheet to form the various walls at angles relative to each other to provide omnidirectional antenna coverage.

Figure 3:
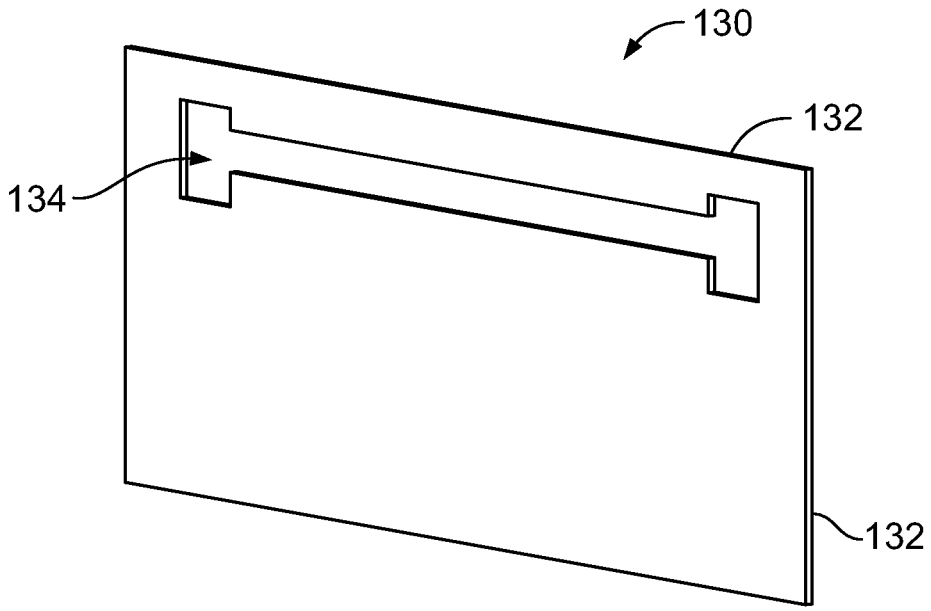
FIG. 3 is a perspective view of a stamped metal sheet used to form the antenna in accordance with an exemplary embodiment.

FIG. 3 is a perspective view of a stamped metal sheet 130 used to form the antenna 102 in accordance with an exemplary embodiment. The stamped metal sheet 130 may be stamped from a larger metal sheet. In the illustrated embodiment, the stamped metal sheet 130 is generally rectangular in shape. The stamped metal sheet 130 may have other shapes in alternative embodiments. The stamped metal sheet 130 includes edges 132 that are stamped or cut from the larger metal sheet. In an exemplary embodiment, a slot 134 is stamped or cut from the stamped metal sheet 130. The slot 134 is located within the interior of the stamped metal sheet 130, such as spaced apart from the edges 132.

Figure 4:
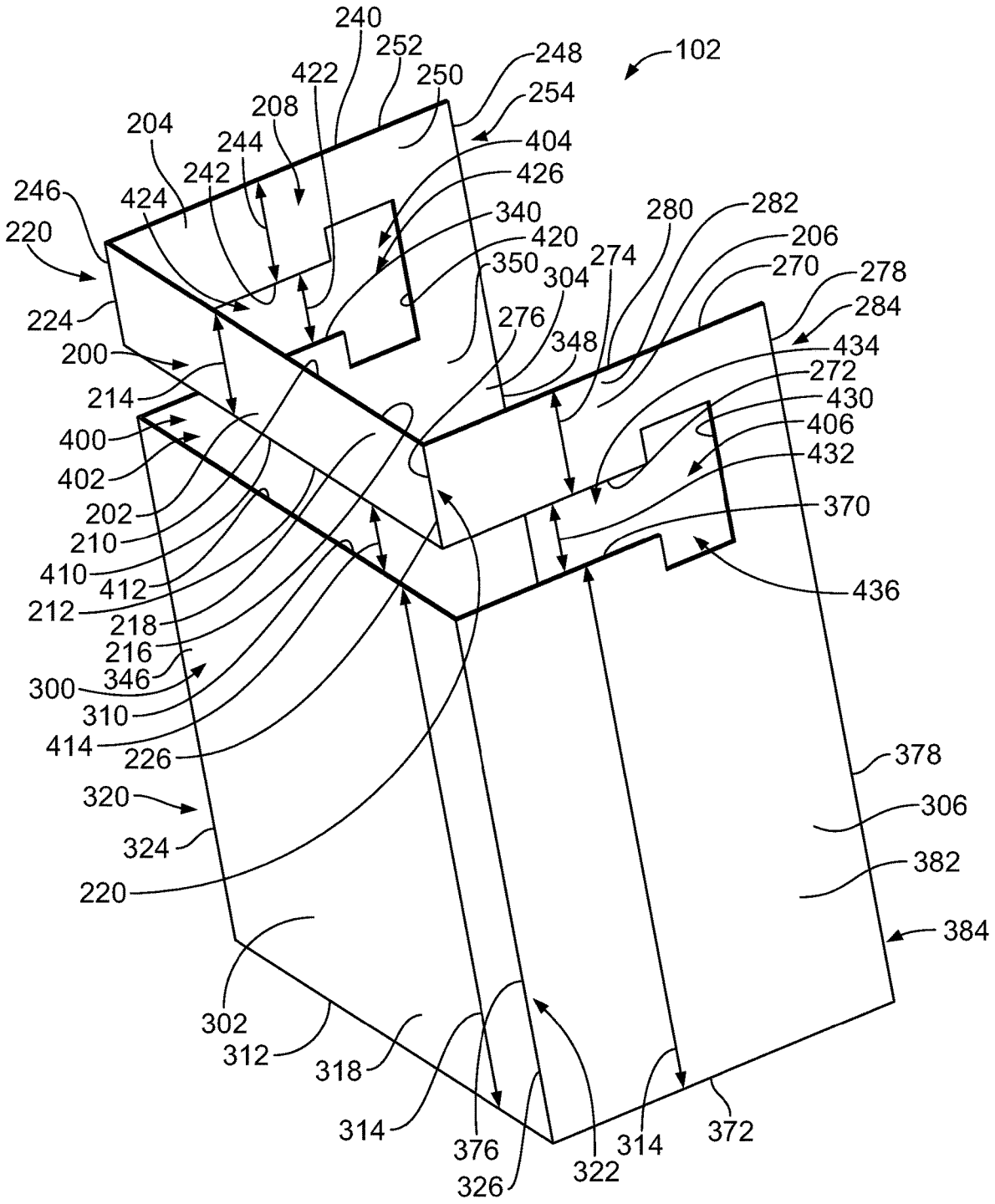
FIG. 4 is a rear perspective view of the antenna in accordance with an exemplary embodiment.
Figure 5:
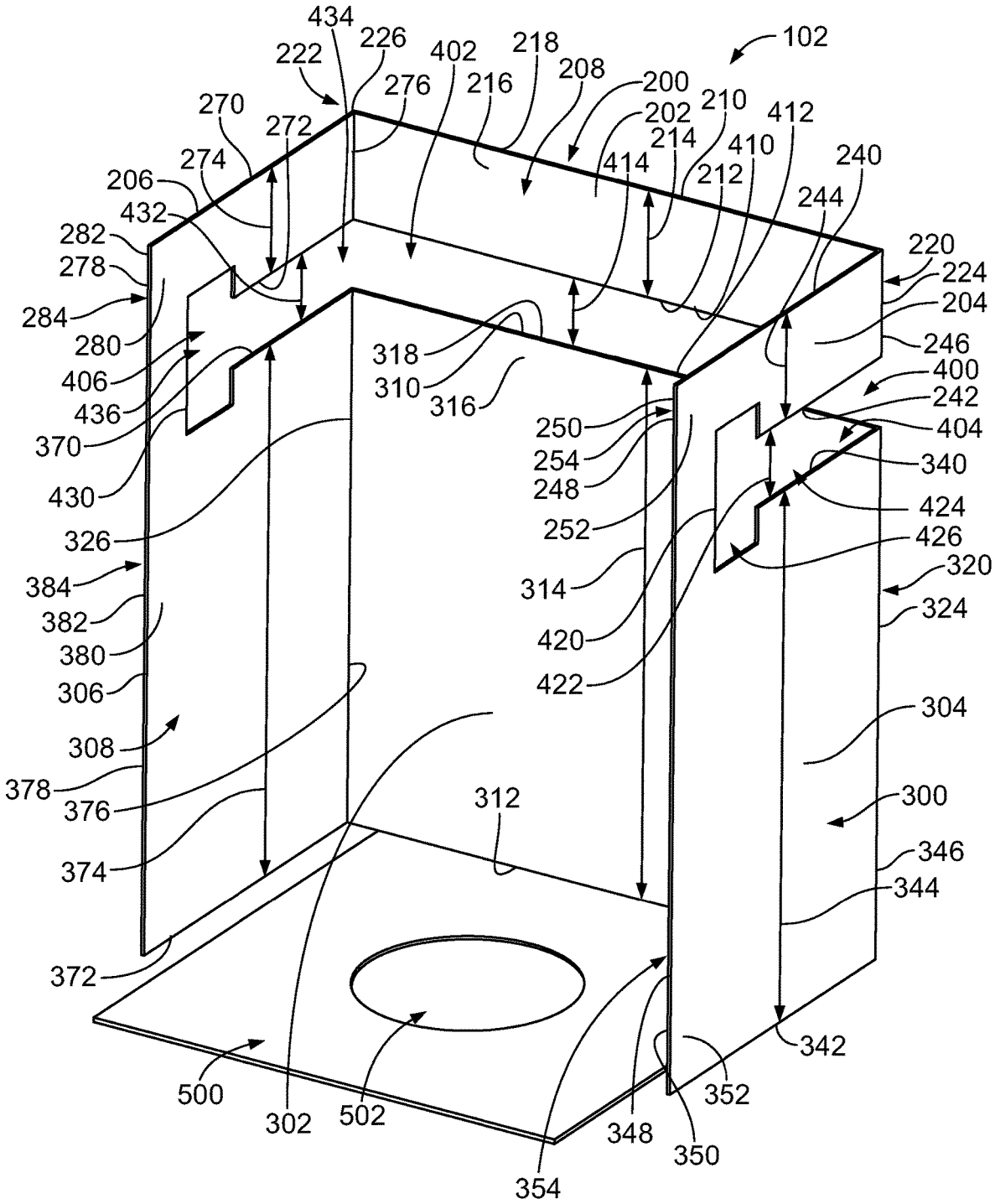
FIG. 5 is a front perspective view of the antenna in accordance with an exemplary embodiment.

FIG. 4 is a rear perspective view of the antenna 102 in accordance with an exemplary embodiment. FIG. 5 is a front perspective view of the antenna 102 in accordance with an exemplary embodiment. The antenna 102 is formed from the stamped metal sheet 130 (shown in FIG. 3). For example, the antenna 102 is formed by bending the stamped metal sheet 130 into a predetermined antenna shape.

The antenna 102 includes a feed element 200, a ground element 300, a slot 400 between the feed element 200 and the ground element 300, and a mounting bracket 500 (FIG. 5) used for mounting the antenna 102 to the substrate 120 (shown in FIG. 2). In an exemplary embodiment, the mounting bracket 500 extends from the ground element 300. The antenna 102 may be provided without the mounting bracket 500 in alternative embodiments. The size, shape, and position of the feed element 200 affects antenna characteristics of the antenna 102. The size, shape, and position of the ground element 300 affects antenna characteristics of the antenna 102. The size, shape, and position of the slot 400 affects antenna characteristics of the antenna 102.

The feed element 200 includes a feed end wall 202, a first feed side wall 204, and a second feed side wall 206. The feed end wall 202, the first feed side wall 204, and the second feed side wall 206 form an antenna cavity 208. The feed element 200 extends along three sides of the antenna cavity 208 (e.g., the rear side, a first side and a second side, respectively) in the illustrated embodiment. The front side of the antenna cavity 208 is open in the illustrated embodiment. The antenna cavity 208 may have other shapes in an alternative embodiment.

The feed end wall 202 extends between a top 210 and a bottom 212. The feed end wall 202 has a height 214 between the top 210 and the bottom 212. In an exemplary embodiment, the top 210 of the feed end wall 202 defines a top of the antenna 102. In an exemplary embodiment, the bottom 212 of the feed end wall 202 faces and/or defines the slot 400. The feed end wall 202 includes a front surface 216 and a rear surface 218 opposite the front surface 216. The feed end wall 202 has a thickness between the front surface 216 and the rear surface 218. The feed end wall 202 extends between a first side 220 and a second side 222. The first feed side wall 204 extends from the first side 220 at a first corner 224. The second feed side wall 206 extends from the second side 222 at a second corner 226. The feed end wall 202 has a width between the first corner 224 at the first side 220 and the second corner 226 at the second side 222. In an exemplary embodiment, the feed end wall 202 is planar. In an exemplary embodiment, the feed end wall 202 is vertically oriented.

The first feed side wall 204 extends between a top 240 and a bottom 242. The first feed side wall 204 has a height 244 between the top 240 and the bottom 242. In various embodiments, the height 244 may be approximately equal to the height 214 of the feed end wall 202. In an exemplary embodiment, the top 240 of the first feed side wall 204 defines a top of the antenna 102. In an exemplary embodiment, the bottom 242 of the first feed side wall 204 faces and/or defines the slot 400 along a portion of the first feed side wall 204. The bottom 242 of the first feed side wall 204 may face a side wall of the ground element 300 along a portion of the first feed side wall 204. The first feed side wall 204 includes a rear edge 246 at the first corner 224 and an outer edge 248 at a front 254 of the first feed side wall 204. The outer edge 248 may define a front of the antenna 102. A portion of the first feed side wall 204 may be located forward of the slot 400. The first feed side wall 204 has a length between the rear edge 246 and the outer edge 248. The first feed side wall 204 includes a first inner surface 250 and a first outer surface 252 opposite the first inner surface 250. The first inner surface 250 faces the antenna cavity 208. The first feed side wall 204 has a thickness between the first inner surface 250 and the first outer surface 252. The thickness of the first feed side wall 204 may be the same as the thickness of the feed end wall 202 because the feed end wall 202 and the first feed side wall 204 are stamped from the same metal sheet. In an exemplary embodiment, the first feed side wall 204 is planar. In an exemplary embodiment, the first feed side wall 204 is vertically oriented.

The second feed side wall 206 extends between a top 270 and a bottom 272. The second feed side wall 206 has a height 274 between the top 270 and the bottom 272. In various embodiments, the height 274 may be approximately equal to the height 214 of the feed end wall 202. In an exemplary embodiment, the top 270 of the second feed side wall 206 defines a top of the antenna 102. In an exemplary embodiment, the bottom 272 of the second feed side wall 206 faces and/or defines the slot 400 along a portion of the second feed side wall 206. The bottom 272 of the second feed side wall 206 may face a side wall of the ground element 300 along a portion of the second feed side wall 206. The second feed side wall 206 includes a rear edge 276 at the second corner 226 and an outer edge 278 at a front 284 of the second feed side wall 206. The outer edge 278 may define a front of the antenna 102. A portion of the second feed side wall 206 may be located forward of the slot 400. The second feed side wall 206 has a length between the rear edge 276 and the outer edge 278. The length may be approximately equal to the length of the first feed side wall 204 in various embodiments. The second feed side wall 206 includes a second inner surface 280 and a second outer surface 282 opposite the second inner surface 280. The second inner surface 280 faces the antenna cavity 208. The second feed side wall 206 has a thickness between the second inner surface 280 and the second outer surface 282. The thickness of the second feed side wall 206 may be the same as the thickness of the feed end wall 202 and the thickness of the first feed side wall 204 because the second feed side wall 206 is stamped from the same metal sheet as the feed end wall 202 and the first feed side wall 204. In an exemplary embodiment, the second feed side wall 206 is planar. In an exemplary embodiment, the second feed side wall 206 is vertically oriented. In various embodiments, the second feed side wall 206 is identical to the first feed side wall 204.

The ground element 300 includes a ground end wall 302, a first ground side wall 304, and a second ground side wall 306. The ground end wall 302, the first ground side wall 304, and the second ground side wall 306 form an antenna cavity 308. The antenna cavity 308 is located below the antenna cavity 208 of the feed element 200. The ground element 300 extends along three sides of the antenna cavity 308 (e.g., the rear side, a first side and a second side, respectively) in the illustrated embodiment. The front side of the antenna cavity 308 is open in the illustrated embodiment. The antenna cavity 308 may have other shapes in an alternative embodiment.

The ground end wall 302 extends between a top 310 and a bottom 312. The ground end wall 302 has a height 314 between the top 310 and the bottom 312. In various embodiments, the height 314 of the ground end wall 302 may be taller than the height 214 of the feed end wall 202. For example, the height 314 may be at least 2× the height 214. In other various embodiments, the height 314 may be at least 4× the height 214. In an exemplary embodiment, the bottom 312 of the ground end wall 302 defines a bottom of the antenna 102. In an exemplary embodiment, the top 310 of the ground end wall 302 faces and/or defines the slot 400. The ground end wall 302 includes a front surface 316 and a rear surface 318 opposite the front surface 316. The ground end wall 302 has a thickness between the front surface 316 and the rear surface 318. The thickness is equal to the thickness of the feed end wall 202. The ground end wall 302 extends between a first side 320 and a second side 322. The first ground side wall 304 extends from the first side 320 at a first corner 324. The second ground side wall 306 extends from the second side 322 at a second corner 326. The ground end wall 302 has a width between the first corner 324 at the first side 320 and the second corner 326 at the second side 322. The width may be equal to the width of the feed end wall 202. For example, the first side 320 may be aligned with the first side 220 and the second side 322 may be aligned with the second side 222. In an exemplary embodiment, the ground end wall 302 is planar. In various embodiments, the ground end wall 302 is coplanar with the feed end wall 202. In an exemplary embodiment, the ground end wall 302 is vertically oriented.

The first ground side wall 304 extends between a top 340 and a bottom 342. The first ground side wall 304 has a height 344 between the top 340 and the bottom 342. In various embodiments, the height 344 may be approximately equal to the height 314 of the ground end wall 302. In an exemplary embodiment, the bottom 242 of the first ground side wall 304 defines the bottom of the antenna 102. In an exemplary embodiment, the top 340 of the first ground side wall 304 faces and/or defines the slot 400 along a portion of the first ground side wall 304. The top 340 of the first ground side wall 304 may face the first feed side wall 204 along a portion of the first ground side wall 304. The first ground side wall 304 includes a rear edge 346 at the first corner 324 and an outer edge 348 at a front 354 of the first ground side wall 304. The outer edge 348 may define a front of the antenna 102. The outer edge 348 may be aligned with the outer edge 248 of the first feed side wall 204. A portion of the first ground side wall 304 may be located forward of the slot 400. The first ground side wall 304 has a length between the rear edge 346 and the outer edge 348. The length may be equal to the length. The first ground side wall 304 includes a first inner surface 350 and a first outer surface 352 opposite the first inner surface 350. The first inner surface 350 faces the antenna cavity 308. The first ground side wall 304 has a thickness between the first inner surface 350 and the first outer surface 352. The thickness of the first ground side wall 304 may be the same as the thickness of the ground end wall 302 because the ground end wall 302 and the first ground side wall 304 are stamped from the same metal sheet. In an exemplary embodiment, the first ground side wall 304 is planar. The first ground side wall 304 is coplanar with the first feed side wall 204. In an exemplary embodiment, the first ground side wall 304 is vertically oriented.

The second ground side wall 306 extends between a top 370 and a bottom 372. The second ground side wall 306 has a height 374 between the top 370 and the bottom 372. In various embodiments, the height 374 may be approximately equal to the height 314 of the ground end wall 302. In an exemplary embodiment, the bottom 372 of the second ground side wall 306 defines the bottom of the antenna 102. In an exemplary embodiment, the top 370 of the second ground side wall 306 faces and/or defines the slot 400 along a portion of the second ground side wall 306. The top 370 of the second ground side wall 306 may face the second feed side wall 206 along a portion of the second ground side wall 306. The second ground side wall 306 includes a rear edge 376 at the second corner 326 and an outer edge 378 at a front 384 of the second ground side wall 306. The outer edge 378 may define a front of the antenna 102. The outer edge 378 may be aligned with the outer edge 278. A portion of the second ground side wall 306 may be located forward of the slot 400. The second ground side wall 306 has a length between the rear edge 376 and the outer edge 378. The length may be approximately equal to the length of the first ground side wall 304 in various embodiments. The second ground side wall 306 includes a second inner surface 380 and a second outer surface 382 opposite the second inner surface 380. The second inner surface 380 faces the antenna cavity 308. The second ground side wall 306 has a thickness between the second inner surface 380 and the second outer surface 382. The thickness of the second ground side wall 306 may be the same as the thickness of the ground end wall 302 and the thickness of the first ground side wall 304 because the second ground side wall 306 is stamped from the same metal sheet as the ground end wall 302 and the first ground side wall 304. In an exemplary embodiment, the second ground side wall 306 is planar. The second ground side wall 306 is coplanar with the second feed side wall 206. In an exemplary embodiment, the second ground side wall 306 is vertically oriented. In various embodiments, the second ground side wall 306 is identical to the first ground side wall 304.

The slot 400 is located between the feed element 200 and the ground element 300. The slot 400 includes a first slot portion 404 between the first feed side wall 204 and the first ground side wall 304. The slot 400 includes a second slot portion 406 between the second feed side wall 206 and the second ground side wall 306. The slot 400 including a third slot portion 402 between the feed end wall 202 and the ground end wall 302. The third slot portion 402 is continuous between the first slot portion 404 and the second slot portion 406. For example, the third slot portion 402 is open to the first slot portion 404 and is open to the second slot portion 406. The first slot portion 404 and the second slot portion 406 extend at an angle relative to the third slot portion 402. For example, the first slot portion 404 and/or the second slot portion 406 may be oriented perpendicular to the third slot portion 402.

The third slot portion 402 is located between the feed end wall 202 and the ground end wall 302. The third slot portion 402 extends the width of the antenna 102 between the first and second sides of the antenna 102. The third slot portion 402 is located at the rear of the antenna 102. The third slot portion 402 has a height 414 between a top 410 and a bottom 412 of the third slot portion 402. In various embodiments, the height 414 may be less than the height 214 and/or the height 314. In the illustrated embodiment, the height 414 is less than 10% of the overall height of the antenna 102. The height 214 of the feed end wall 202 may be less than 10% of the overall height of the antenna 102. The height 314 of the ground end wall 302 may be greater than 80% of the overall height of the antenna 102. The heights may be different in alternative embodiments.

The first slot portion 404 extends forward of the third slot portion 402. For example, the first slot portion 404 may extend from the third slot portion 402 to a front edge 420. A portion of the first feed side wall 204 and/or the first ground side wall 304 may be located forward of the front edge 420. In an exemplary embodiment, a height 422 of the first slot portion 404 may be variable along the length of the first slot portion 404. For example, the first slot portion 404 includes a narrow portion 424 and a wide portion 426. In the illustrated embodiment, the wide portion 426 is located at the front edge 420. The narrow portion 424 extends between the wide portion 426 and the third slot portion 402. In an exemplary embodiment, the first slot portion 404 may include cut-outs or notches at the top and/or at the bottom to form the wide portion 426. For example, the first slot portion 404 may be T-shaped or L-shaped. The first slot portion 404 may have other shapes in alternative embodiments to define the narrow portion 424 and the wide portion 426. In the illustrated embodiment, the first slot portion 404 includes an upper notch forming an upper slot portion and a lower notch forming a lower slot portion to define the wide portion 426. The upper slot portion and the lower slot portion increase the height 422 of the first slot portion 404 compared to the height along the narrow portion 424. The upper slot portion may have different dimensions than the lower slot portion in various embodiments. The height 422 at the wide portion 426 between the top and the bottom of the first slot portion 404 is greater than the height 422 at the narrow portion 424. The first slot portion 404 may extend into the first feed side wall 204 and/or into the first ground side wall 304. The wide portion 426 may be arranged at the end of the first slot portion 404. However, the wide portion 426 may be arranged at other locations, such as having narrow portions 424 on both sides of the wide portion 426 rather than being at the end. Optionally, the narrow portion(s) 424 may have a variable height rather than having a uniform height. Optionally, the wide portion(s) 426 may have a variable height rather than having a uniform height. The first slot portion 404 may have other shapes in alternative embodiments. In an exemplary embodiment, the first slot portion 404 is vertically oriented. In an exemplary embodiment, the first slot portion 404 is non-coplanar with the third slot portion 402.

The second slot portion 406 extends forward of the third slot portion 402. For example, the second slot portion 406 may extend from the third slot portion 402 to a front edge 430. A portion of the second feed side wall 206 and/or the second ground side wall 306 may be located forward of the front edge 430. In an exemplary embodiment, a height 432 of the second slot portion 406 may be variable along the length of the second slot portion 406. For example, the second slot portion 406 includes a narrow portion 434 and a wide portion 436. In the illustrated embodiment, the wide portion 436 is located at the front edge 430. The narrow portion 434 extends between the wide portion 436 and the third slot portion 402. In an exemplary embodiment, the second slot portion 406 may include cut-outs or notches at the top and/or at the bottom to form the wide portion 436. For example, the second slot portion 406 may be T-shaped or L-shaped. The second slot portion 406 may have other shapes in alternative embodiments to define the narrow portion 434 and the wide portion 436. In the illustrated embodiment, the second slot portion 406 includes an upper notch forming an upper slot portion and a lower notch forming a lower slot portion to define the wide portion 436. The upper slot portion and the lower slot portion increase the height 432 of the second slot portion 406 compared to the height along the narrow portion 434. The upper slot portion may have different dimensions than the lower slot portion in various embodiments. The height 432 at the wide portion 436 between the top and the bottom of the second slot portion 406 is greater than the height 432 at the narrow portion 434. The second slot portion 406 may extend into the second feed side wall 206 and/or into the second ground side wall 306. The wide portion 436 may be arranged at the end of the second slot portion 406. However, the wide portion 436 may be arranged at other locations, such as having narrow portions 434 on both sides of the wide portion 436 rather than being at the end. Optionally, the narrow portion(s) 434 may have a variable height rather than having a uniform height. Optionally, the wide portion(s) 436 may have a variable height rather than having a uniform height. The second slot portion 406 may have other shapes in alternative embodiments. The second slot portion 406 may be shaped identical to the first slot portion 404. Alternatively, the slot portions 404, 406 may be shaped differently than each other. In an exemplary embodiment, the second slot portion 406 is vertically oriented. In an exemplary embodiment, the second slot portion 406 is non-coplanar with the third slot portion 402.

The mounting bracket 500 is stamped and formed with the walls of the antenna 102. The mounting bracket 500 is located at the bottom of the antenna 102. In an exemplary embodiment, the mounting bracket 500 extends from the bottom 312 of the ground end wall 302. The mounting bracket 500 is bent perpendicular to the ground end wall 302. In an exemplary embodiment, the mounting bracket 500 includes an opening 502 that receives a fastener (not shown) used to secure the mounting bracket 500 to the substrate 120 (shown in FIG. 1). In other embodiments, the mounting bracket 500 may be secured to the substrate 120 by soldering, using adhesive, or other means. In an exemplary embodiment, the mounting bracket 500 may be electrically connected to the ground plane 124 of the substrate 120.

Figure 6:
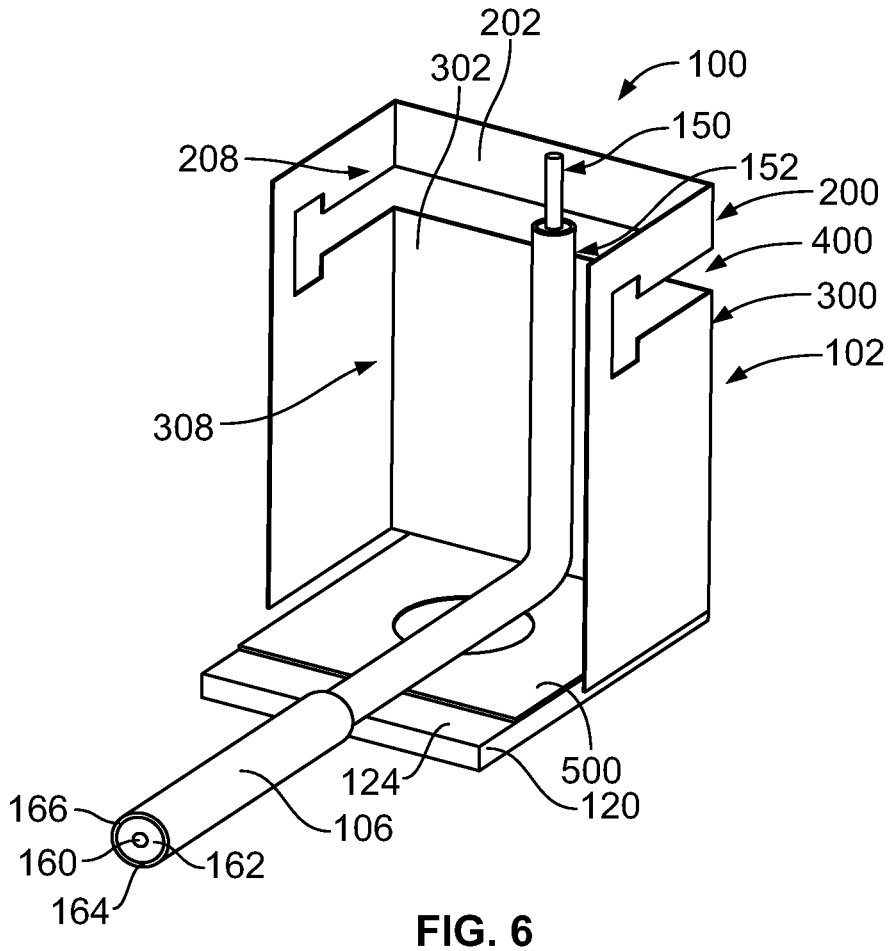
FIG. 6 illustrates the antenna assembly in accordance with an exemplary embodiment showing a coaxial cable coupled to the antenna.

FIG. 6 illustrates the antenna assembly 100 in accordance with an exemplary embodiment showing the coaxial cable 106 coupled to the antenna 102. The coaxial cable 106 includes a cable feed 150 electrically connected to the feed element 200 of the antenna 102 and a cable ground 152 electrically connected to the ground element 300 of the antenna 102. In an exemplary embodiment, the coaxial cable 106 includes a center conductor 160, an insulator 162 surrounding the center conductor 160, a cable shield 164 surrounding the insulator 162 and a cable jacket 166 surrounding the cable shield 164. A portion of the cable jacket 166 may be removed or stripped to expose the cable shield 164 for connection to the antenna 102. A portion of the insulator 162 and the cable shield 164 may be removed or stripped to expose the center conductor 160 for connection to the antenna 102. The center conductor 160 defines the cable feed 150. The cable shield 164 defines the cable ground 152.

An end of the coaxial cable 106 extends into the antenna cavity 208 and/or 308 of the antenna 102. In various embodiments, the coaxial cable 106 may extend along the substrate 120 into the antenna 102 where the end of the coaxial cable 106 is bent along the ground end wall 302 and the feed end wall 202. The coaxial cable 106 may enter the antenna 102 from a different direction, such as from below the substrate 120 passing through the substrate 120 into the antenna cavity 308, 208. The center conductor 160 is terminated to the feed element 200. For example, the center conductor 160 may be soldered to the feed element 200, such as at the feed end wall 202. The center conductor 160 spans across the slot 400 to interface with the feed element 200. The cable shield 164 is terminated to the ground element 300. For example, the cable shield 164 may be soldered to the ground element 300, such as at the ground end wall 302. In various embodiments, the cable shield 164 may be electrically connected to the mounting bracket 500. In various embodiments, the cable shield 164 may be electrically connected to the ground plane 124 of the substrate 120.

Figure 7:
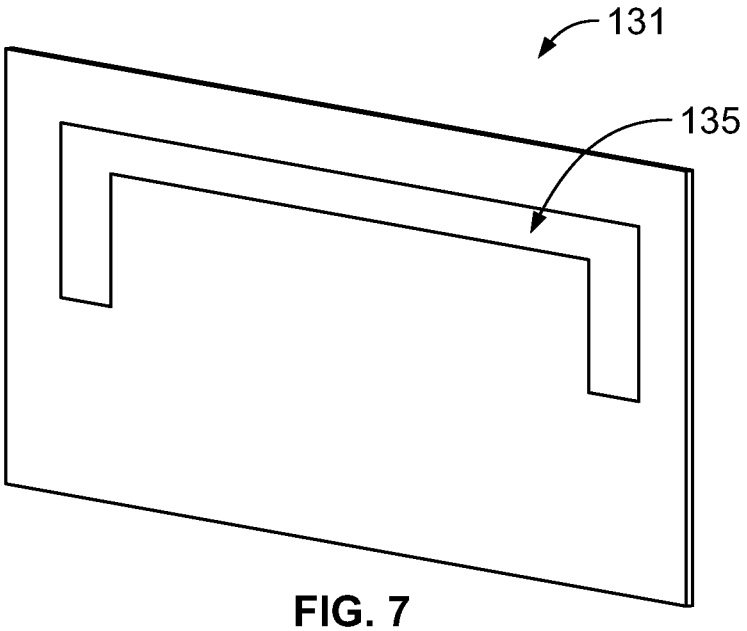
FIG. 7 is a perspective view of a stamped metal sheet used to form the antenna in accordance with an exemplary embodiment.
Figure 8:
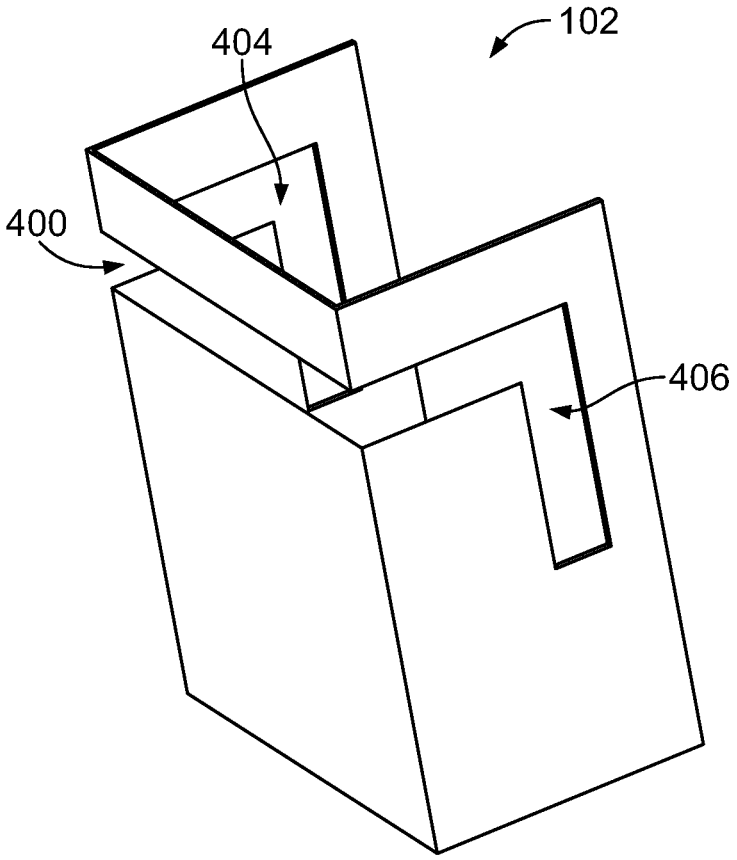
FIG. 8 is a perspective view of the antenna in accordance with an exemplary embodiment formed by the stamped metal sheet shown in FIG. 7.

FIG. 7 is a perspective view of a stamped metal sheet 131 used to form the antenna 102 in accordance with an exemplary embodiment. FIG. 8 is a perspective view of the antenna 102 formed by the stamped metal sheet 131 in accordance with an exemplary embodiment. The stamped metal sheet 131 has a slot 135 that is shaped differently than the slot 134 (shown in FIG. 3) of the stamped metal sheet 130 (shown in FIG. 3). The slot 135 defines the slot 400 of the antenna 102, which has a different shape than the slot 400 illustrated in FIGS. 4 and 5.

In the illustrated embodiment, the first and second slot portions 404, 406 are L-shaped rather than being T-shaped as in the embodiment illustrated in FIGS. 4 and 5. The size and shape of the slot portions 404, 406 affect the antenna characteristics of the antenna 102. In an exemplary embodiment, the slot portions 404, 406 include notches or cutouts that extend downward. The notches may be angled 90°. The slot 400 may have other shapes in alternative embodiments. For example, the notches of the slot portions 404, 406 extend upward. The notches may extend at angles other than 90°. Optionally, the slot portions 404, 406 may be shaped differently than each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An antenna comprising:

a feed element including a feed end wall, a first feed side wall, and a second feed side wall, the first feed side wall extending from a first side of the feed end wall at a first corner, the second feed side wall extending from a second side of the feed end wall at a second corner;

a ground element including a ground end wall, a first ground side wall, and a second ground side wall, the first ground side wall extending from a first side of the ground end wall at a first corner, the second ground side wall extending from a second side of the ground end wall at a second corner; and a slot between the feed element and the ground element, the slot including a first slot portion between the first feed side wall and the first ground side wall, the slot including a second slot portion between the second feed side wall and the second ground side wall, and the slot including a third slot portion between the feed end wall and the ground end wall, the third slot portion being continuous between the first slot portion and the second slot portion.

2. The antenna of claim 1, wherein the first feed side wall extends perpendicular to the feed end wall and the second feed side wall extends perpendicular to the feed end wall, and wherein the first ground side wall extends perpendicular to the ground end wall and the second ground side wall extends perpendicular to the ground end wall.

3. The antenna of claim 1, wherein the feed element is vertically oriented and the ground element is vertically oriented.

4. The antenna of claim 1, wherein the ground element extends perpendicular from a ground plane.

5. The antenna of claim 1, wherein the slot is oriented parallel to a ground plane below the ground element.

6. The antenna of claim 1, wherein the feed end wall, the first feed side wall, and the second feed side wall are stamped from a metal sheet, the ground end wall, the first ground side wall, and the second ground side wall being stamped from the metal sheet, the first slot portion, the second slot portion, and the third slot portion being stamped from the metal sheet, the first feed side wall and the second feed side wall being formed by bending at the first corner and the second corner of the feed element, the first ground side wall and the second ground side wall being formed by bending at the first corner and the second corner of the ground element.

7. The antenna of claim 1, wherein the feed end wall is planar, the first feed side wall being planar and angled relative to the feed end wall, the second feed side wall being planar and angled relative to the feed end wall, and wherein the ground end wall is planar, the first ground side wall being planar and angled relative to the ground end wall, the second ground side wall being planar and angled relative to the ground end wall.

8. The antenna of claim 7, wherein the feed end wall is co-planer with the ground end wall, the first feed side wall being co-planar with the first ground side wall, and the second feed side wall being co-planar with the second ground side wall.

9. The antenna of claim 1, wherein the feed end wall includes a front surface and a rear surface, the first feed side wall extending from the feed end wall to a first front edge forward of the front surface of the feed end wall, the second feed side wall extending from the feed end wall to a second front edge forward of the front surface of the feed end wall, and wherein the ground end wall includes a front surface and a rear surface, the first ground side wall extending from the ground end wall to a first front edge forward of the front surface of the ground end wall, the second ground side wall extending from the ground end wall to a second front edge forward of the front surface of the ground end wall.

10. The antenna of claim 9, wherein the first feed side wall includes a first inner surface extending between the feed end wall and the first front edge and a first outer surface opposite the first inner surface, the second feed side wall including a second inner surface extending between the feed end wall and the second front edge and a second outer surface opposite the second inner surface, the first ground side wall includes a first inner surface extending between the ground end wall and the first front edge and a first outer surface opposite the first inner surface, the second ground side wall including a second inner surface extending between the ground end wall and the second front edge and a second outer surface opposite the second inner surface, wherein the first inner surface of the feed element faces the second inner surface of the feed element and wherein the first inner surface of the ground element faces the second inner surface of the ground element.

11. The antenna of claim 1, wherein the antenna includes an antenna cavity forward of the feed end wall and the ground end wall, the antenna cavity located between the first feed side wall and the second feed side wall, the antenna cavity located between the first ground side wall in the second ground side wall.

12. The antenna of claim 1, wherein the antenna includes a mounting flange extending from a bottom edge of the ground element, the mounting flange configured to be mounted to a substrate.

13. The antenna of claim 1, wherein the feed element has a feed height between a top of the feed element and a bottom of the feed element, the ground element having a ground height between a top of the ground element and a bottom of the ground element, the ground height being greater than the feed height.

14. The antenna of claim 13, wherein the slot includes a slot height between the feed element and the ground element, the slot height being less than 10% of an overall height of the antenna and the feed height being less than 10% of the overall height of the antenna.

15. An antenna assembly comprising:

an antenna including a feed element, a ground element and a slot between the feed element and the ground element, the feed element including a feed end wall, a first feed side wall, and a second feed side wall, the first feed side wall extending from a first side of the feed end wall at a first corner, the second feed side wall extending from a second side of the feed end wall at a second corner, the ground element including a ground end wall, a first ground side wall, and a second ground side wall, the first ground side wall extending from a first side of the ground end wall at a first corner, the second ground side wall extending from a second side of the ground end wall at a second corner, the slot including a first slot portion between the first feed side wall and the first ground side wall, the slot including a second slot portion between the second feed side wall and the second ground side wall, and the slot including a third slot portion between the feed end wall and the ground end wall, the third slot portion being continuous between the first slot portion and the second slot portion; and an antenna cable including a cable feed electrically connected to the feed element and a cable ground electrically connected to the ground element.

16. The antenna assembly of claim 15, wherein the antenna cable is a coaxial cable having a center conductor, and insulator around the center conductor, a shield around the insulator, and a jacket around the shield, the center conductor forming the cable feed and the shield forming the cable ground.

17. The antenna assembly of claim 15, further comprising a substrate having a ground plane, the antenna being mounted to the substrate such that the ground element is electrically connected to the ground plane.

18. An antenna assembly comprising:

a substrate having an upper surface;

an antenna mounted to the upper surface of the antenna, the antenna including a feed element, a ground element, a slot between the feed element and the ground element, and a mounting flange extending from the ground element being mounted to the upper surface of the antenna, the feed element including a feed end wall, a first feed side wall, and a second feed side wall, the first feed side wall extending from a first side of the feed end wall at a first corner, the second feed side wall extending from a second side of the feed end wall at a second corner, the ground element including a ground end wall, a first ground side wall, and a second ground side wall, the first ground side wall extending from a first side of the ground end wall at a first corner, the second ground side wall extending from a second side of the ground end wall at a second corner, the slot including a first slot portion between the first feed side wall and the first ground side wall, the slot including a second slot portion between the second feed side wall and the second ground side wall, and the slot including a third slot portion between the feed end wall and the ground end wall, the third slot portion being continuous between the first slot portion and the second slot portion; and an antenna cable including a cable feed electrically connected to the feed element and a cable ground electrically connected to the ground element.

19. The antenna assembly of claim 18, wherein the mounting flange extends from a bottom edge of the ground end wall.

20. The antenna assembly of claim 18, wherein the substrate includes a ground plane electrically connected to the ground element.

* * * * *